US007596337B2

(12) United States Patent
Sato

(10) Patent No.: US 7,596,337 B2
(45) Date of Patent: Sep. 29, 2009

(54) CLEANER UNIT AND IMAGE FORMING APPARATUS INCLUDING THE SAME

(75) Inventor: Atsushi Sato, Aichi-ken (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 218 days.

(21) Appl. No.: 11/689,765

(22) Filed: Mar. 22, 2007

(65) Prior Publication Data

US 2007/0230991 A1 Oct. 4, 2007

(30) Foreign Application Priority Data

Mar. 30, 2006 (JP) ..... 2006-095015

(51) Int. Cl.
*G03G 15/16* (2006.01)
*G03G 21/12* (2006.01)
*G03G 21/00* (2006.01)

(52) U.S. Cl. ..... 399/101; 399/99; 399/360

(58) Field of Classification Search ..... 399/101, 399/357, 360

See application file for complete search history.

(56) References Cited

U.S. PATENT DOCUMENTS

| | | | | |
|---|---|---|---|---|
| 4,739,370 | A | 4/1988 | Yoshida et al. | |
| 5,614,996 | A | 3/1997 | Tanda | |
| 5,842,093 | A | 11/1998 | Tanda | |
| 5,848,342 | A | 12/1998 | Tanda | |
| 6,819,350 | B2 * | 11/2004 | Yokoi | 347/228 |
| 7,016,639 | B2 | 3/2006 | Park et al. | |
| 2003/0031490 | A1 * | 2/2003 | Takahashi | 399/359 |
| 2005/0047816 | A1 * | 3/2005 | Uchida et al. | 399/101 |

FOREIGN PATENT DOCUMENTS

| | | |
|---|---|---|
| JP | 60-107677 | 6/1985 |
| JP | 60-250379 | 12/1985 |
| JP | 62-217278 | 9/1987 |
| JP | 62-244081 | 10/1987 |
| JP | 10-88966 | 6/1989 |
| JP | 3-103468 | 10/1991 |
| JP | 4-045474 | 2/1992 |
| JP | 5-341697 | 12/1993 |
| JP | 6-194997 | 7/1994 |
| JP | 8-062919 | 3/1996 |
| JP | 9-068901 | 3/1997 |
| JP | 2003241596 | 8/2003 |
| JP | 2005010751 | 1/2005 |
| JP | 2005173350 | 6/2005 |

* cited by examiner

*Primary Examiner*—David M Gray
*Assistant Examiner*—Andrew V Do
(74) *Attorney, Agent, or Firm*—Banner & Witcoff, LTD.

(57) ABSTRACT

A cleaner unit includes a cleaner roller, a cleaner shaft, a blade, a toner container, and a toner squeeze pump. The cleaner roller collects toner adhered to a surface of a belt to a surface of the cleaner roller. The cleaner shaft collects the toner adhered to the surface of the cleaner roller to a surface of the cleaner shaft. The blade scrapes off the toner adhered to the surface of the cleaner shaft. The toner squeeze pump delivers the toner scraped off by the blade toward an opening of a storage space and compresses the toner stored in the storage space. A part of a bottom wall of the toner container which continues from the opening extends in a substantially horizontal direction, when the cleaner unit is attached to an image forming apparatus.

18 Claims, 6 Drawing Sheets

FIG.4

| EXP NO | DIAMETER OF ELLIPTIC ROTOR | θ | L1 | L2 | |
|---|---|---|---|---|---|
| 1 | 10 mm | 90° | 3 mm | 1.5 mm | WASTE TONER UNCONVEYABLE |
| 2 | 10 mm | 90° | 2 mm | 1.5 mm | WASTE TONER CONVEYABLE |
| 3 | 10 mm | 90° | 1 mm | 1.5 mm | WASTE TONER CONVEYABLE |
| 4 | 10 mm | 90° | 0.5 mm | 1.5 mm | WASTE TONER CONVEYABLE BUT LARGE ROTARY TORQUE IN ELLIPTIC ROTOR |
| 5 | 10 mm | 135° | 2 mm | 1 mm | WASTE TONER HEAPED UP ON WALL AND UNCONVEYABLE |
| 6 | 10 mm | 135° | 1 mm | 1 mm | WASTE TONER HEAPED UP ON WALL AND UNCONVEYABLE |
| 7 | 10 mm | 135° | 0.5 mm | 1 mm | WASTE TONER HEAPED UP ON WALL AND UNCONVEYABLE |

FIG.5

| EXP NO | DIAMETER OF ELLIPTIC ROTOR | $\theta$ | |
|---|---|---|---|
| 2 | 10 mm | 90° | WASTE TONER CONVEYABLE |
| 8 | 8 mm | 135° | WASTE TONER HEAPED UP ON WALL AND UNCONVEYABLE |
| 9 | 8 mm | 110° | WASTE TONER HEAPED UP ON WALL AND UNCONVEYABLE |

FIG.6

| EXP NO | DIAMETER OF ELLIPTIC ROTOR | θ | L2 | L3 | L4 | |
|---|---|---|---|---|---|---|
| 10 | 10 mm | 90° | 3.4 mm | 1 mm | | WASTE TONER HEAPED UP BETWEEN ROTOR AND WALL AND UNCONVEYABLE / WASTE TONER ACCUMULATES IN L4 PART (TONER ACCUMULATED IN L4 PART RUNS ON TO TONER ON WALL) |
| 11 | 10 mm | 90° | 2.4 mm | 1 mm | | WASTE TONER HEAPED UP BETWEEN ROTOR AND WALL AND UNCONVEYABLE / WASTE TONER ACCUMULATES IN L4 PART (TONER ACCUMULATED IN L4 PART RUNS ON TO TONER ON WALL) |
| 12 | 10 mm | 90° | 1.9 mm | 1 mm | | WASTE TONER HEAPED UP BETWEEN ROTOR AND WALL AND UNCONVEYABLE / WASTE TONER ACCUMULATES IN L4 PART (TONER ACCUMULATED IN L4 PART RUNS ON TO TONER ON WALL) |
| 13 | 10 mm | 90° | 1.4 mm | 1 mm | | WASTE TONER HEAPED UP BETWEEN ROTOR AND WALL AND UNCONVEYABLE / WASTE TONER ACCUMULATES IN L4 PART (TONER ACCUMULATED IN L4 PART RUNS ON TO TONER ON WALL) |
| 14 | 10 mm | 90° | | 0.1 mm | 1.5 mm | SUBTLE LEAK OF WASTE TONER TO OPPOSITE SIDE OF WALL / NO ACCUMULATION OF WASTE TONER IN L4 PART |
| 15 | 10 mm | 90° | | 0.1 mm | 2.5 mm | LEAK OF WASTE TONER TO OPPOSITE SIDE OF WALL / NO ACCUMULATION OF WASTE TONER IN L4 PART |

CLEANER UNIT AND IMAGE FORMING APPARATUS INCLUDING THE SAME

CROSS-REFERENCE TO RELATED APPLICATIONS

This application claims the benefit of Japanese Patent Application No. 2006-95015 filed Mar. 30, 2006 in the Japan Patent Office, the disclosure of which is incorporated herein by reference.

BACKGROUND

This invention relates to an electrophotographic image forming apparatus.

Electrophotographic image forming apparatus are known to transfer toner (developer) onto a recording medium such as a recording sheet and an OHP sheet to form an image onto the recording medium. During the transfer, however, part of the supplied toner is likely to adhere to a photosensitive drum and a conveyor mechanism belt to form waste toner.

If printing (image formation) is performed with the photosensitive drum and the conveyor mechanism belt to which the waste toner adhered, the waste toner is retransferred onto the reverse side of the recording medium. An undesirable image may be formed onto the recording medium.

A conventional electrophotographic image forming apparatus is therefore provided with a waste toner container that collects the waste toner so as to avoid forming an undesirable image onto the recording medium.

SUMMARY

The larger the capacity of the waste toner container, the more of the waste toner can be collected in the container. As a result, exchange frequency of the container can be reduced. Utility for a user is improved. However, in order to include a large container in an image forming apparatus, the image forming apparatus has to be undesirably increased in size. The size of the image forming apparatus may be larger than preferred.

In the aforementioned image forming apparatus, the waste toner container may be formed to be flat so that the height of the container remains short but the capacity of the container can be expanded in a horizontal direction. A conveying roller may be also provided at the entrance of the container for the purpose of conveying the collected toner to the waste toner container. However, it is difficult to convey the waste toner to the inner part of the container even in use of the conveying roller. A dead space is created in the container in which the waste toner can never be stored.

In the aforementioned image forming apparatus, volumetric efficiency is small between the waste toner container and the waste toner actually stored. Thus, the waste toner container has to be elongated in a vertical direction so as to store a sufficient amount of waste toner.

Accordingly, in the aforementioned image forming apparatus, there is a problem that the waste toner container, and consequently, the image forming apparatus, may be increased in size.

It would be desirable to reduce an image forming apparatus in size, in a vertical direction, while allowing the image forming apparatus to store a sufficient amount of waste toner.

A cleaner unit may be detachable from an electrophotographic image forming apparatus provided with a belt. It would be desirable that the cleaner unit includes a cleaner roller, a cleaner shaft, a blade, a toner container, and a toner squeeze pump. The cleaner roller is brought into contact with the belt. The cleaner shaft is brought into contact with the cleaner roller. The blade is brought into contact with the cleaner shaft. The toner container includes a storage space storing toner and an opening allowing toner to be delivered to the storage space. The toner squeeze pump is provided outside the storage space. The cleaner roller collects toner adhered to a surface of the belt to a surface of the cleaner roller. The cleaner shaft collects the toner adhered to the surface of the cleaner roller to a surface of the cleaner shaft. The blade scrapes off the toner adhered to the surface of the cleaner shaft. The toner squeeze pump delivers the toner scraped off by the blade toward an opening of the storage space and compresses the toner stored in the storage space. A part of a bottom wall of the toner container which continues from the opening extends in a substantially horizontal direction, when the cleaner unit is attached to the image forming apparatus.

The cleaner roller may be made of polyurethane foam or silicone rubber foam. The cleaner shaft may be made of metal. The blade may be made of polyurethane.

BRIEF DESCRIPTION OF THE DRAWINGS

The invention will now be described below, by way of example, with reference to the accompanying drawings, in which:

FIG. 4 is a table showing test results of conveying state of waste toner when minimum gap sizes between an elliptic rotor and a rotor housing and an angle between a first wall and a second wall are used as testing parameters;

FIG. 5 is a table showing test results of conveying state of waste toner when the angle between the first wall and the second wall is used as a testing parameter; and FIG. 6 is a table showing test results of conveying state of waste toner when a width size of an apex of the second wall and a distance from the apex of the second wall to a peripheral surface of a cleaning shaft are used as testing parameters.

DETAILED DESCRIPTION OF THE PREFERRED EMBODIMENT

In the present embodiment, an electrophotographic image forming apparatus according to the invention is applied to a laser printer which is used connected to a computer.

1. External Structure of Laser Printer

Figure 1:
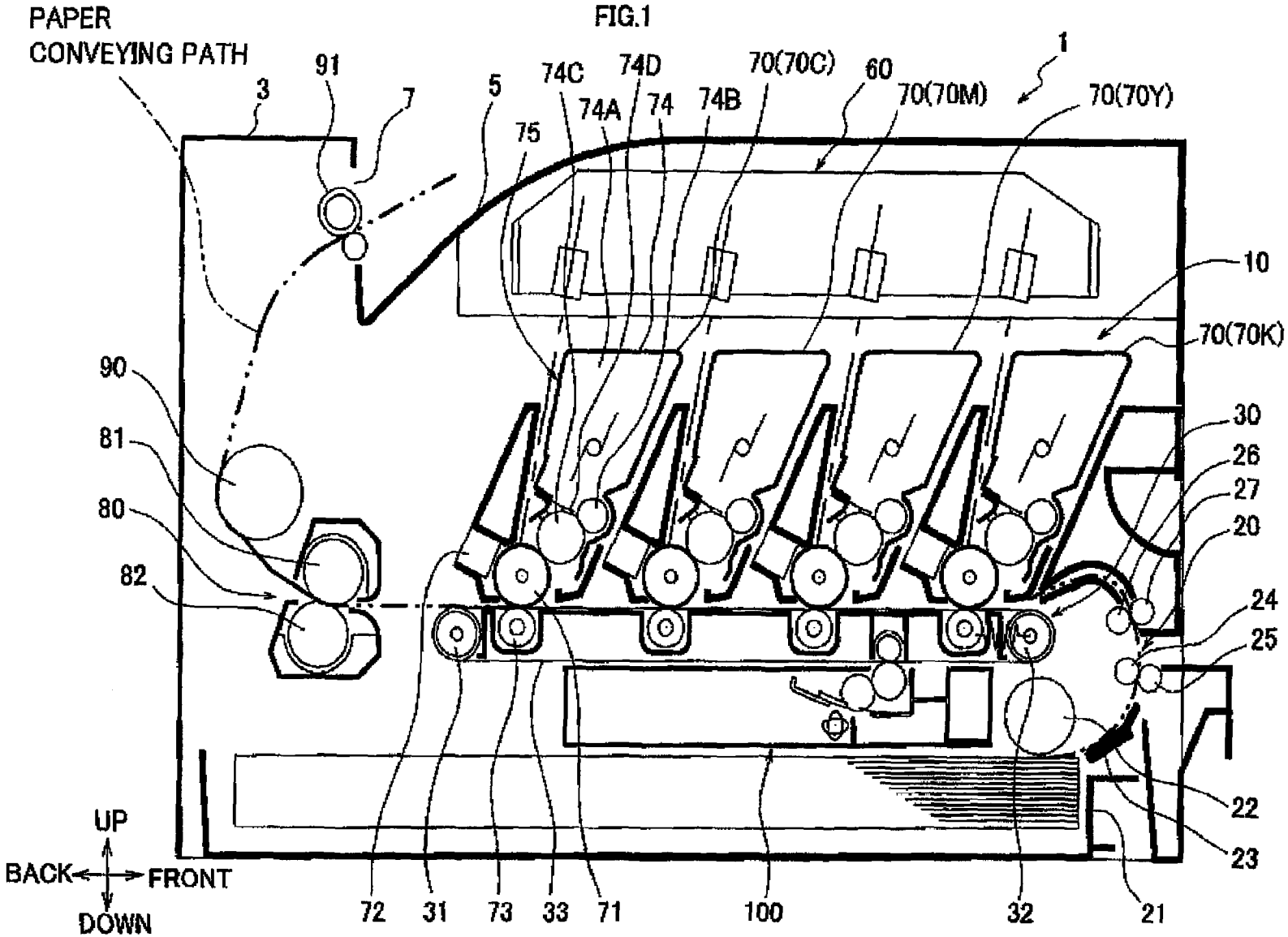
FIG. 1 is a sectional side view showing main parts of a laser printer according to an embodiment.

FIG. 1 shows main parts of a laser printer 1 of the present embodiment. In FIG. 1, the upper side in FIG. 1 is regarded as upward in the direction of gravity. The right side in FIG. 1 is normally regarded as the front side.

A housing 3 of the laser printer 1 is formed into a substantially box-like (e.g., square) shape. A discharge tray 5 is provided on the top of the housing 3 so as to receive a printed sheet or an OHP sheet (hereinafter, simply referred to as "paper") discharged from the housing 3.

In the present embodiment, the housing 3 is provided with a not shown frame member made of metal or resin therein. Component members such as a developer toner cartridge 70 and a fixing unit 80 are detachably attached to the frame member.

2. Internal Structure of Laser Printer

The laser printer 1 includes an image forming portion 10, a feeder portion 20, and a conveyer 30. The image forming portion 10 forms an image on paper. The feeder portion 20 feeds the paper to the image forming portion 10. The conveyer 30 conveys the paper to four developing toner cartridges 70K, 70Y, 70M, and 70C composing the image forming portion 10.

The paper to which image formation is completed at the image forming portion 10 is turned around so that a conveying direction of the paper is rotated upward by approximately 180° at an intermediate conveying roller 90 and a not shown discharge chute. Then, the paper is discharged from a discharge portion 7 onto the discharge tray 5 by a discharge roller 91.

2.1. Feeder Portion

The feeder portion 20 includes a feed tray 21, a feed roller 22, and a separation pad 23. The feed tray 21 is provided at the bottom of the housing 3. The feed roller 22 is provided at the upper front of the feed tray 21. The feed roller 22 feeds (conveys) paper placed on the feed tray 21 to the image forming portion 10. The separation pad 23 applies a predetermined conveying resistance to the paper fed by the feed roller 22 so as to separate the paper one by one.

The paper on the feed tray 21 is conveyed to the image forming portion 10 disposed in a substantially middle part of the housing 3 as if to make a U-turn at the front side of the housing 3. For this purpose, a conveying roller 24 that applies a conveying force to the paper is provided at a region making a U-turn in a paper conveying path between the feed tray 21 and the image forming portion 10.

A pressure roller 25 is disposed to face the conveying roller 24 across the paper conveying path to press paper onto the conveying roller 24. The pressure roller 25 is pressed against the conveying roller 24 by a not shown resilient member such as a coil spring.

Registration rollers 26 and 27 are provided downstream of the conveying roller 24 in the paper conveying direction. The registration roller 26 abuts the front end of the paper conveyed by the conveying roller 24 so as to correct orientation of the paper. The registration roller 26 then conveys the paper toward the image forming portion 10. The registration roller 27 is provided to face the registration roller 26. The registration roller 27 is pressed against the registration roller 26 by a not shown resilient member such as a coil spring.

2.2. Conveyer

The conveyer 30 includes a drive roller 31, a driven roller 32, and a conveyor belt 33. The drive roller 31 rotates in conjunction with the operation of the image forming portion 10. The driven roller 32 is rotatably disposed at a distance from the drive roller 31. The conveyor belt 33 runs between the drive roller 31 and the driven roller 32.

Paper conveyed from the feed tray 21 is sequentially conveyed toward the vicinity of the four developer toner cartridges 70K, 70Y, 70M, and 70C, as the conveyor belt 33 rotates with the paper positioned thereon.

A belt cleaner 100 removes toner adhered to the surface of the conveyor belt 33. From now on, details of the belt cleaner 100 will be described.

2.2.1. Details of Belt Cleaner 100

Figure 2:
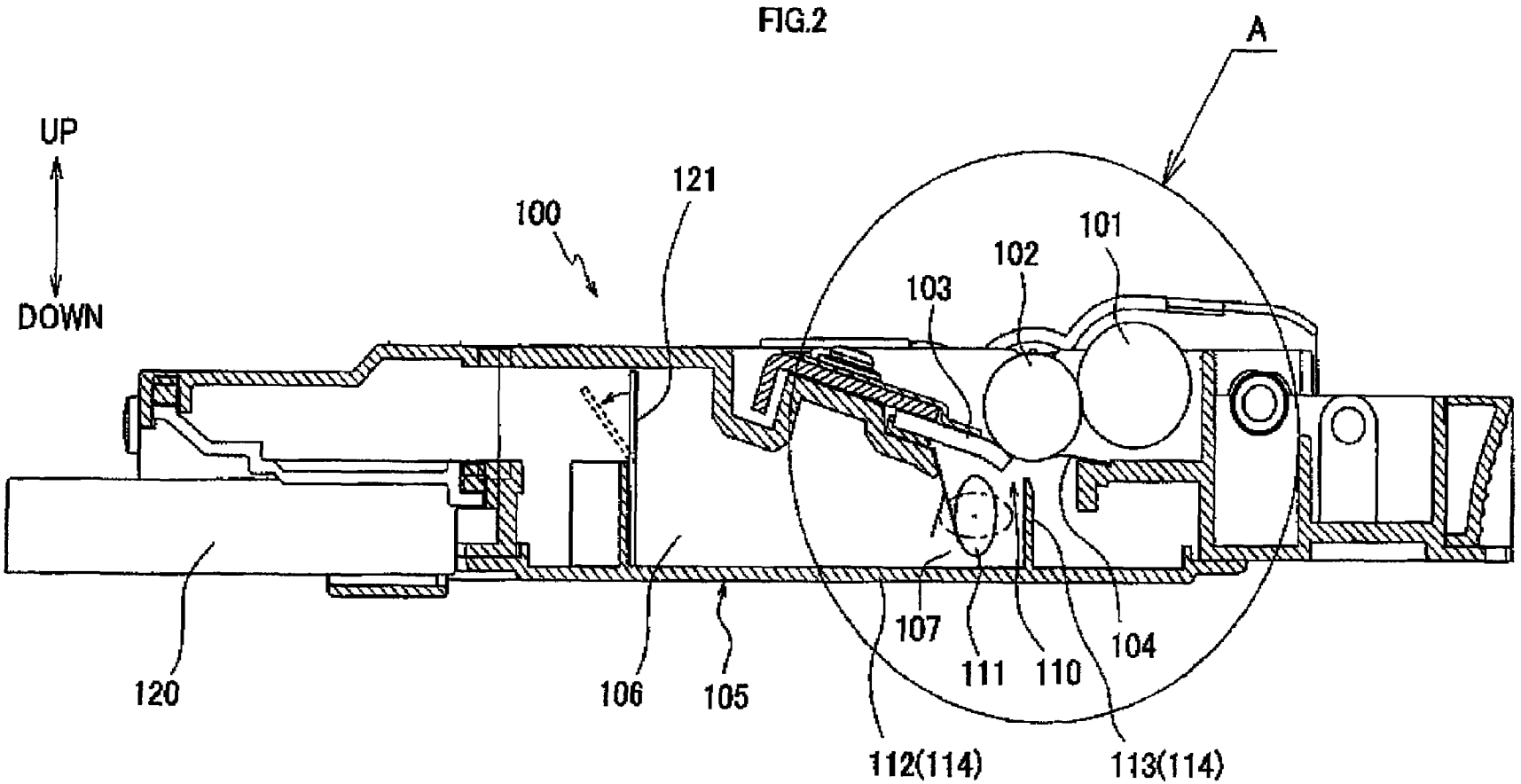
FIG. 2 is an enlarged view of a belt cleaner according to the embodiment.
Figure 3:
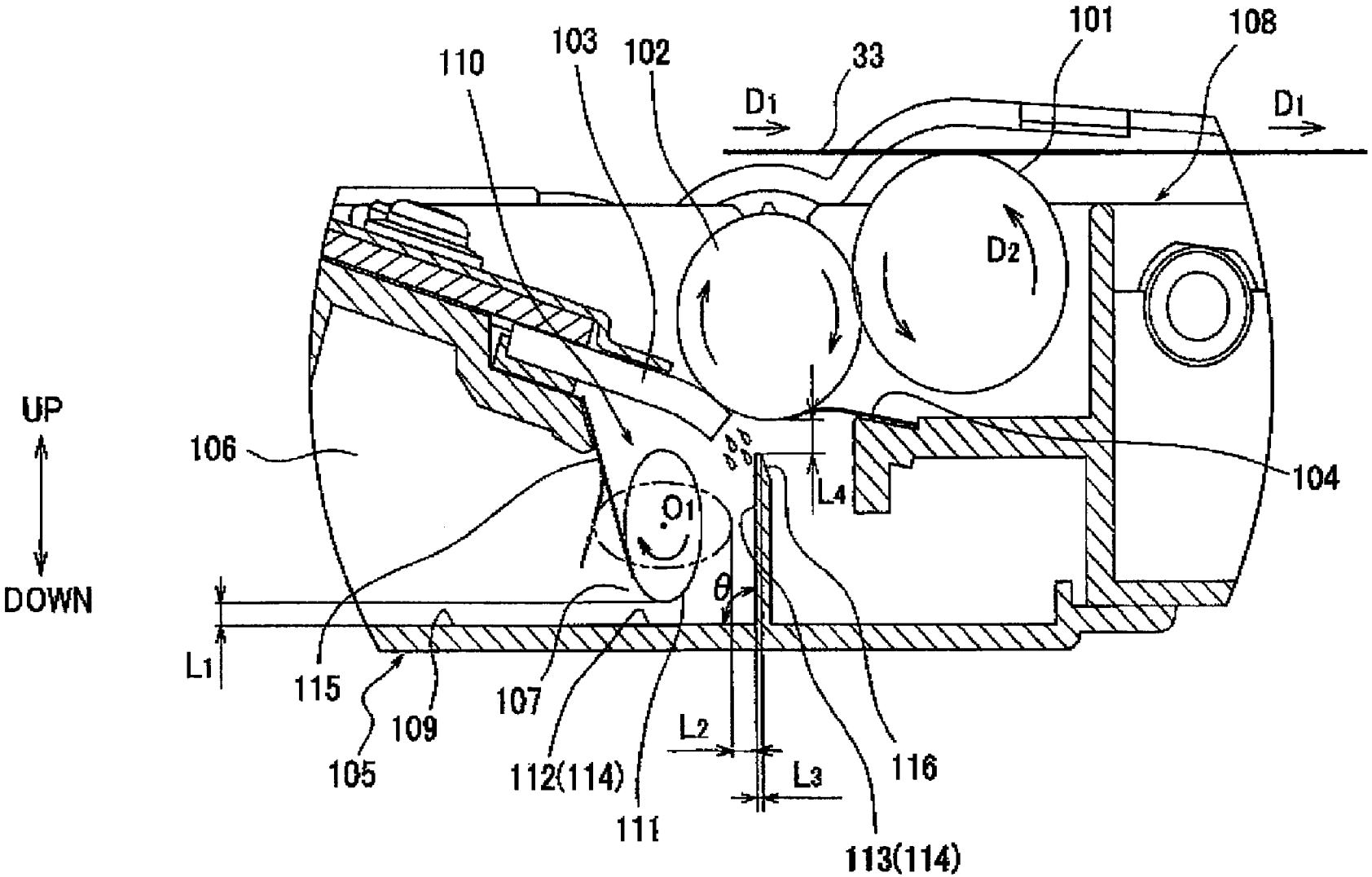
FIG. 3 is an enlarged view of a portion A in FIG. 2.

FIG. 2 is an enlarged view of the belt cleaner 100. FIG. 3 is an enlarged view of a portion A of FIG. 2. For example, the belt cleaner 100 is detachably installed inside the housing 3 on the lower side of the conveyor belt 33. Particularly, the belt cleaner 100 may be designed to be capable of being attached to and detached from the frame member provided in the housing 3.

In FIG. 3, a cleaning roller 101 removes toner adhered to the surface of the conveyor belt 33. A cleaning shaft 102 conveys the toner adhered to the cleaning roller 101 toward a waste toner container 105.

The cleaning roller 101 may be, for example, made of polyurethane foam or silicone rubber foam. The cleaning shaft 102 may be, for example, made of metal.

In the present embodiment, the cleaning roller 101 is brought into contact with the conveyor belt 33 while rotating in reverse of a rotation direction D1 of the conveyor belt 33. In this manner, the toner adhered to the conveyor belt 33 is scraped off to be removed.

An electric charge (negative charge in the present embodiment) opposite to an electric charge of the toner is applied to the cleaning shaft 102. The cleaning shaft 102 is then brought into contact with the external surface of the cleaning roller 101 while being rotated. In this manner, the toner adhered to the surface of the cleaning roller 101 is transferred to the cleaning shaft 102 and removed from the cleaning roller 101.

The waste toner adhered to the surface of the cleaning shaft 102 is scraped off by a release blade 103. The release blade 103 is formed into a thin plate. The waste toner is then conveyed to the waste toner container 105 by the waste toner squeeze pump mechanism 110.

The blade 103 may be, for example, made of polyurethane.

An antiscattering blade 104 prevents scattering of waste toner scraped off from the cleaning shaft 102 to the side of the cleaning roller 101. One end of the antiscattering blade 104 is secured to the inner wall of a casing 108. The other end of the antiscattering blade 104 is formed into a flexible film which slidably abuts on the outer surface of the cleaning shaft 102.

The waste toner container 105 includes a storage space 106 in which the waste toner is collected. The waste toner squeeze pump mechanism 110 is provided on the outer side of the storage space 106 across an entrance 107 of the storage space 106 (waste toner container 105). The waste toner squeeze pump mechanism 110 is capable of compressing the waste toner collected in the storage space 106.

The waste toner squeeze pump mechanism 110 includes an elliptic rotor 111, a rotor housing 114, and a toner retaining member, which may be a reed valve 115. The elliptic rotor 111 pushes the waste toner scraped off from the cleaning shaft 102 toward the entrance 107 by rotating. The rotor housing 114 is provided to enclose the elliptic rotor 111. The reed valve 115 prohibits the waste toner delivered into the storage space 106 from flowing backward to the outside of the storage space 106.

The elliptic rotor 111 has a substantially elliptic cross section. The elliptic rotor 111 rotates around a rotation axis orthogonal to the cross section. The rotor housing 114 is composed of a first wall 112 and a second wall 113. The first wall 112 extends in a horizontal direction continuing from the entrance 107 of the toner container 105. The second wall 113 extends substantially orthogonal to the first wall 112.

The reed valve 115 may be in the form of an elastic thin plate which slidably abuts on the peripheral surface of the elliptic rotor 111 from the side of the entrance 107 toward a rotation center O1 of the elliptic rotor 111.

Due to the above structure, when a force from the inside toward the outside of the storage space 106 acts on the reed valve 115 in the waste toner squeeze pump mechanism 110 of the present embodiment, contact surface pressure between the reed valve 115 and the elliptic rotor 111 is increased.

Accordingly, even if a force large enough to open the reed valve 115 acts on the reed valve 115, by increased pressure inside the storage space 106 due to the pressure of the compressed waste toner, the reed valve 115 is reliably prohibited from being open. Thus, the waste toner would not leak out of the storage space 106.

As shown in FIG. 2, a waste toner measurement sensor 120 is provided on the back side (left side in FIG. 2) in a horizontal direction of the waste toner container 105. The waste toner measurement sensor 120 determines whether the waste toner stored in the storage space 106 has reached a predetermined amount. The waste toner measurement sensor 120 generates a signal when a switch (not shown) is depressed by the pressure of the compressed waste toner provided inside the storage space 106.

An elastic film door 121 is provided on the side of the entrance 107 of the waste toner measurement sensor 120 in such a manner as to partition the storage space 106 into the entrance 107 side and the waste toner measurement sensor 120 side. The film door 121 is designed to be opened by pressure of the waste toner stored on the entrance 107 side when the pressure has reached to a predetermined level.

Accordingly, in the present embodiment, the waste toner measurement sensor 120 does not operate simply by filling the storage space 106 with waste toner. The waste toner measurement sensor 120 operates when the inner pressure inside the storage space 106 has exceeded the predetermined level.

2.3. Image Forming Portion

Referring to FIG. 1, the image forming portion 10 includes a scanner portion 60, a developer toner cartridge 70, and a fixing unit 80.

The image forming portion 10 of the present embodiment is of a so-called direct tandem type which allows color printing. In the present embodiment, four toner cartridges 70K, 70Y, 70M, and 70C corresponding to four colors of toner (developer), that is black, yellow, magenta, and cyan, are arranged in series from the upstream side along the paper conveying direction.

The four developer toner cartridges 70K, 70Y, 70M, and 70C are only different in color of ink stored therein, and identical in structure. Accordingly, the four developer toner cartridges 70K, 70Y, 70M, and 70C are collectively called developer toner cartridges 70.

2.3.1. Scanner Portion

The scanner portion 60 forms an electrostatic latent image on the surface of a photosensitive drum 71. The photosensitive drum 71 is provided in the upper portion in the housing 3. The photosensitive drum 71 is respectively provided for each of the four developer toner cartridges 70K, 70Y, 70M, and 70C. Particularly, the scanner portion 60 includes a laser source, a polygon mirror, fθ lens and a reflector.

A laser beam emitted from the laser source based on image data is biased by the polygon mirror. After passing the fθ lens, the beam is reflected and bent downward by the reflector. As a result, the beam is radiated on the surface of the photosensitive drum 71 to form an electrostatic latent image.

2.3.2. Developer Toner Cartridge

Hereinafter, the structure of the developer toner cartridge 70C is explained as an example by way of FIG. 1.

The developer toner cartridge 70 is detachably arranged inside the housing 3 on the down side of the scanner portion 60. The developer toner cartridge 70 is provided with a casing 75 which accommodates the photosensitive drum 71, a charger 72, and a toner container 74.

A transfer roller 73 is rotatably supported to the frame member on the side opposite to the photosensitive drum 71 across the conveyer belt 33.

The photosensitive drum 71 carries an image to be transferred onto paper. The photosensitive drum 71 has a cylindrical shape, the outmost surface of which is formed by a positively charged photosensitive layer, for example, made of polycarbonate.

The charger 72 charges the surface of the photosensitive drum 71. The charger 72 is disposed obliquely upward at the back of the photosensitive drum 71. The charger 72 is disposed at a predetermined distance from the photosensitive drum 71 so as not to contact the photosensitive drum 71.

The charger 72 according to the present embodiment employs a scorotron charger which positively charges the surface of the photosensitive drum 71 substantially evenly by using corona discharge from charging wire, for example, made of tungsten.

The transfer roller 73 is disposed to face with the photosensitive drum 71 and rotates in conjunction with rotation of the transfer belt 33. When the paper passes near the photosensitive drum 71, the transfer roller 73 applies an electric charge (negative charge in the present embodiment) opposite to the electric charge of the photosensitive drum 71 to the paper from the surface side opposite to a print surface of the paper, so as to transfer the toner adhered to the surface of the photosensitive drum 71 onto the print surface.

The toner container 74 includes a toner chamber 74A, a toner supply roller 74B and a developer roller 74C. The toner chamber 74A stores toner. The toner supply roller 74B and the developer roller 74C supply toner to the photosensitive drum 71.

The toner stored in the toner chamber 74A is supplied to the developer roller 74C by the rotation of the toner supply roller 74B. The toner supplied to the developer roller 74C is carried onto the surface of the developer roller 74C. The carried toner is adjusted to have a predetermined thickness (to be even) on the surface of the developer roller 74C by a layer thickness control blade 74D. The toner is then supplied to the surface of the photosensitive drum 71 exposed by the scanner portion 60.

2.3.3. Fixing Unit

The fixing unit 80 is disposed downstream of the photosensitive drum 71 in the paper conveying direction. The fixing unit 80 heats and melts the toner transferred onto the paper to be fixed. The fixing unit 80 is detachably attached to the aforementioned frame member.

Particularly, the fixing unit 80 includes a beating roller 81, and a pressure roller 82. The heating roller 81 is disposed on the side of the print surface of the paper. The heating roller 81 applies a conveying force to the paper while heating the toner. The pressure roller 82 is disposed to face the heating roller 81 across the paper. The pressure roller 82 presses the paper toward the side of the heating roller 81.

The heating roller 81 is rotationally driven in synchronization with the developer roller 74C and the conveyer belt 33. The pressure roller 82 is rotated by a rotational force of the heating roller 81 via the paper contacting the heating roller 81.

2.3.4. Outline of Image Forming Operation

In the image forming portion 10, an image is formed onto the paper as follows.

That is, the surface of the photosensitive drum 71, along with the rotation thereof, is positively and uniformly charged by the charger 72. Then, the surface of the photosensitive drum 71 is exposed by rapid scanning of a laser beam emitted from the scanner portion 60. Thereby, an electrostatic latent image corresponding to an image to be formed on the paper is formed on the surface of the photosensitive drum 71.

Next, the positively charged toner carried onto the developer roller 74C by the rotation thereof is supplied to the electrostatic latent image formed on the surface of the photosensitive drum 71, that is, a part of the surface of the uniformly and positively charged photosensitive drum 71 which is exposed by a laser beam and where the electric potential is lowered, when brought into contact with the photosensitive drum 71. Thereby, the electrostatic latent image on the photosensitive drum 71 is visualized. A toner image by reversal development is carried on the surface of the photosensitive drum 71.

Thereafter, the toner image on the photosensitive drum 71 is transferred onto the paper by a transfer bias applied to the transfer roller 73. The paper to which the toner image is transferred is conveyed to the fixing unit 80 and heated. The toner transferred as the toner image is fixed on the paper to complete image formation.

3. Characteristics of Laser Printer According to Present Embodiment

In the belt cleaner 100 according to the present embodiment, the waste toner inside the storage space 106 can be compressed by the waste toner squeeze pump mechanism 110. Therefore, the waste toner can be accumulated in the waste toner container 105 while being compressed inside the storage space 106.

Accordingly, as shown in FIGS. 2 and 3, even though the portion of a bottom wall 109 (see FIG. 3) of the waste toner container 105 continuing from the entrance 107 of the waste toner container 105 extends in a substantially horizontal direction to form the storage space 106 extending in the horizontal direction, sufficient amount of waste toner can be stored in the waste toner container 105. Therefore, in the present embodiment, miniaturization of the laser printer 1 in a vertical direction can be achieved while a sufficient amount of waste toner can be stored.

In the belt cleaner 100 of the present embodiment, even if the pressure inside the storage space 106 is increased by the compressed waste toner, the reed valve 115 remains closed as mentioned above. Therefore, it is difficult for the waste toner to leak out of the storage space 106. Accordingly, even if the capacity and the vertical size of the storage space 106 are reduced, much waste toner can be stored.

In the elliptic rotor 111 of the waste toner squeeze pump mechanism 110 of the present embodiment, the waste toner is pumped when the reed valve 115 is pushed by each of the two edges of a major axial portion of the elliptic rotor 111, which compresses the waste toner in the storage space 106. Thus, when the elliptic rotor 111 is rotated once, the waste toner is pumped twice.

On the other hand, for example, a rolling piston pump which rotates an eccentric round rotor may be adopted instead of the elliptic rotor 111. In this case, however, when the round rotor rotates once, the waste toner is pumped once. Therefore, the rolling piston pump has lower efficiency than the waste toner squeeze pump mechanism 110 of the present embodiment.

Accordingly, the belt cleaner 100 of the present embodiment allows efficient collection of the waste toner.

As shown in FIG. 3, the waste toner scraped off from the cleaning shaft 102 by the release blade 103 falls into a gap between the elliptic rotor 111 and the second wall 113 to be conveyed toward the entrance 107 along with rotation of the elliptic rotor 111. Therefore, if minimum gap sizes L1 and L2 between the rotor housing 114 and the elliptic rotor 111, that is, the minimum gap size L1 between the first wall 112 and the elliptic rotor 111, and the minimum gap size L2 between the second wall 113 and the elliptic rotor 111, become too large, the amount of waste toner capable of being conveyed is decreased. The amount of waste toner remaining in the gap between the rotor housing 114 and the elliptic rotor 111 is increased. As a result, pumping efficiency of the waste toner squeeze pump mechanism 110 becomes low.

On the other hand, if the minimum gap sizes L1 and L2 between the rotor housing 114 and the elliptic rotor 111 become too small, solidified waste toner or foreign bodies may be easily stuck in the gap between the elliptic rotor 111 and the rotor housing 114. There is high risk of stopping the rotation of the elliptic rotor 111.

Thus, in the present embodiment, the minimum gap L1 between the first wall 112 and the elliptic rotor 111 is set to be 0.3 mm to 2 mm, as later explained. In this manner, occurrence of deficiency is avoided to the waste toner squeeze pump mechanism 110 while decrease in the pumping efficiency is restricted.

Similarly, the minimum gap L2 between the second wall 113 and the elliptic rotor 111 is set to be 0.3 mm or above and below 1.4 mm, as later explained. In this manner, occurrence of deficiency is avoided to the waste toner squeeze pump mechanism 110 while decrease in the pumping efficiency is restricted.

The conveyor belt 33 and the cleaning shaft 102 are disposed above the second wall 113. Thus, there is a fear that the waste toner may be heaped up at the apex of the second wall 113.

The heaped waste toner may fall on the side facing away from the elliptic rotor 111 over the second wall 113. The fallen waste toner may not be conveyed into the storage space 106.

In the present embodiment, a width size L3 at the apex of the second wall 113 is set to be below 1 mm, as later explained. Thereby, the waste toner is prohibited from falling on the side facing away from the elliptic rotor 111 over the second wall 113. The waste toner can be conveyed into the storage space 106. Efficient collection of the waste toner can be achieved.

The narrower the width size L3 of the apex of the second wall 113, the better the waste toner is prevented from being heaped up at the apex of the second wall 113.

However, in the present embodiment, the first and the second walls 112 and 113 are integrally formed by die molding such as injection resin molding. Thus, it is difficult to form the overall second wall 113 from the apex to the base to be thin due to manufacturing constraints.

To overcome the above constraints, the apex of the second wall 113 may be separately manufactured. Thereby, the separately manufactured apex may be attached to an apex portion of the second wall 113 so as to reduce the width size L3 of the apex of the second wall 113. However, this would increase the number of parts and assembling steps of the belt cleaner 100, resulting in increase in manufacturing costs of the laser printer 1.

In the present embodiment, a taper portion 116 where the width size L3 is tapered toward the apex is provided at least on the apex portion of the second wall 113, as shown in FIG. 3. Therefore, the first and the second walls 112 and 113 can be integrally molded by die molding while reducing the width size L3 of the apex of the second wall 113.

Accordingly, in the present embodiment, efficient collection of the waste toner can be achieved without increasing the manufacturing costs of the belt cleaner 100 (rotor housing 114).

If the second wall 113 is bent away from the elliptic rotor 111 so that an angle θ (see FIG. 3) between the first and the second walls 112 and 113 is more than 90°, a lump of waste toner heaped as if leaning on the second wall 113 does not fall apart even if the elliptic rotor 111 is rotated, as later explained. Thus, the waste toner cannot be efficiently collected.

In order to efficiently collect the waste toner, the second wall 113 may be bent toward the elliptic rotor 111 so that the angle θ is less than 90°. However, in the case of integral die molding of the first and the second walls 112 and 113, the second wall 113 cannot be simply cut out in a vertical direction if the second wall 113 is bent toward the elliptic rotor 111. Thus, a die structure may become complicated. The manufacturing costs of the rotor housing 114 may be increased.

In the present embodiment, the second wall 113 is orthogonal to the first wall 112. Thus, the second wall 113 is substantially parallel to a perpendicular direction. Accordingly, collection efficiency of the waste toner is not deteriorated. The second wall 113 can be easily cut out in a vertical direction.

Accordingly, the waste toner can be efficiently collected without increasing the manufacturing costs of the rotor housing 114.

In the present embodiment, the waste toner adhered to the surface of the cleaning shaft 102 is scraped off by the release blade 103. The scraped waste toner may be scattered to the side facing away from the elliptic rotor 111 over the second wall 113. The waste toner may be unable to be conveyed into the storage space 106.

In order to solve the above problem, a distance L4 (see FIG. 3) between the apex of the second wall 113 and the peripheral surface of the cleaning shaft 102 may be reduced. However, if the distance L4 is extremely reduced, the waste toner heaped at the apex of the second wall 113 may expand to the extent to abut the peripheral surface of the cleaning shaft 102.

Then, the expanded waste toner may fall on the side facing away from the elliptic rotor 111 over the second wall 113. The waste toner may be unable to be conveyed into the storage space 106.

In the present embodiment, the distance L4 between the apex of the second wall 113 and the peripheral surface of the cleaning shaft 102 is set to 1.5 mm and above, as later explained. Then, the scraped waste toner is prohibited from being scattered to the side facing away from the elliptic rotor 111 over the second wall 113. The waste toner heaped at the apex of the second wall 113 is prohibited from becoming huge.

The distance L4 may be any distance as far as equal to 1.5 mm and above. However, the extended distance L4 causes the vertical size of the belt cleaner 100 to be large. Thus, in the present embodiment, the distance L4 is set between 1.5 mm to 2.5 mm, in consideration of the vertical size of the belt cleaner 100 and the variations in size.

FIG. 4 shows a table of test results of conveying state of waste toner when the minimum gap sizes L1 and L2 between the elliptic rotor 111 and the rotor housing 114 and the angle θ between the first wall 112 and the second wall 113 are used as testing parameters. Whether or not the waste toner has been favorably conveyed was determined by visual observation.

FIG. 5 shows a table of test results of conveying state of waste toner when the angle θ between the first wall 112 and the second wall 113 is used as a testing parameter. FIG. 6 shows a table of test results of conveying state of waste toner when the width size L3 of the front end of the second wall 113 and the distance L4 from the front end of the second wall 113 to the peripheral surface of a cleaning shaft 102 are used as testing parameters.

FIGS. 4 to 6, the elliptic rotor 111 having a diameter of 8 mm is a prototype, and the elliptic rotor 111 having a diameter of 10 mm is a mass production prototype. The diameter of the elliptic rotor 111 is not a parameter that affects the sizes L1 to L3 and the distance L4.

The elliptic rotor 111 according to the present embodiment is made of resin. There is no problem in strength (bending rigidity) of the elliptic rotor 111 if the diameter is 8 mm and above. The diameter of the mass production prototype is 10 mm in consideration of safety margin.

As shown in FIG. 4, when the minimum gap size L1 between the first wall 112 and the elliptic rotor 111 is set to be 0.3 mm to 2 mm as mentioned above, the waste toner can be favorably conveyed. Also as shown in FIG. 6, when the minimum gap size L2 between the second wall 113 and the elliptic rotor 111 is set to be 0.3 mm or above and below 1.4 mm, the waste toner can be favorably conveyed.

As shown in FIGS. 4 and 5, if the angle θ between the first wall 112 and the second wall 113 is set larger than 90°, a lump of waste toner heaped as if leaning on the second wall 113 does not fall apart, as mentioned above. Regardless of the minimum gap sizes L1 and L2 between the elliptic rotor 111 and the rotor housing 114, the waste toner cannot be smoothly conveyed. Accordingly, it is preferable that the angle θ between the first wall 112 and the second wall 113 is set to be 90° to favorably convey the waste toner.

Also as shown in FIG. 6, when the width size L3 of the apex of the second wall 113 is set to be below 1 mm as mentioned above, accumulation of waste toner can be avoided at the apex of the second wall 113. The waste toner can be favorably conveyed.

Also as shown in FIG. 6, when the distance L4 between the apex of the second wall 113 and the peripheral surface of the cleaning shaft 102 is set to be 1.5 mm and above as aforementioned, the waste toner can be favorably conveyed.

OTHER EMBODIMENTS

In the above embodiment, the elliptic rotor 111 is used in the waste toner squeeze pump mechanism 110. However, for example, a rolling piston pump may be used instead.

Also in the above embodiment, the first wall 112 and the second wall 113 are connected orthogonal to each other. However, for example, the first wall 112 and the second wall 113 may be connected to form a smooth curve which is substantially parallel to a locus drawn by the top of the major axis of the elliptic rotor 111.

An embodiment of the present invention is described in the above. However, it should be noted that the present invention can be practiced in various manners without departing from the scope of the present invention.

What is claimed is:

1. A cleaner unit provided with a belt, the cleaner unit comprising:

a cleaner roller configured to be brought into contact with the belt;

a cleaner shaft configured to be brought into contact with the cleaner roller;

a blade configured to be brought into contact with the cleaner shaft;

a toner container that includes a storage space configured to store toner and an opening allowing toner to be delivered to the storage space; and a toner squeeze pump that is provided outside the storage space, the toner squeeze pump including an elliptic rotor having a substantially elliptic cross section;

a rotor housing provided to enclose the elliptic rotor; and a toner retaining member configured to prohibit the toner from flowing backward outside of the storage space, wherein the elliptic rotor rotates around a rotation axis orthogonal to the elliptic cross section of the elliptic rotor, the rotor housing has a first wall and a second wall, the first wall continuing from the opening and the second wall extending orthogonal to the first wall, and the toner retaining member slidably abuts a peripheral surface of the elliptic rotor from a side of the opening in the storage space toward a rotation center of the elliptic rotor, and wherein the cleaner roller is configured to collects toner adhering to a surface of the belt on a surface of the cleaner roller, the cleaner shaft is configured to collects the toner adhering to the surface of the cleaner roller on a surface of the cleaner shaft, the blade is configured to scrapes off the toner adhering to the surface of the cleaner shaft, the toner squeeze pump is configured to deliver the toner scraped off by the blade toward the opening of the storage space and to compress the toner stored in the storage space, and a part of a bottom wall of the toner container which continues from the opening extends in a substantially horizontal direction, when the cleaner unit is attached to the image forming apparatus.

2. The cleaner unit according to claim 1, wherein a part of the rotor housing which has the first wall and the second wall is integrally formed with the toner container.

3. The cleaner unit according to claim 2, wherein a surface of the second wall which faces the elliptic rotor is substantially parallel to a perpendicular direction.

4. The cleaner unit according to claim 1, wherein a taper portion where a width size is tapered toward an apex of the second wall is provided at least on a side of the apex.

5. The cleaner unit according to claim 1, wherein the toner container is designed as a long member extending in a substantially horizontal direction, when the cleaner unit is attached to the image forming apparatus.

6. An electrophotographic image forming apparatus comprising the cleaner unit according to claim 1 which is detachable from the apparatus.

7. The cleaner unit according to claim 1, wherein the belt moves in a direction opposite a rotation direction of the cleaner roller.

8. The cleaner unit according to claim 1, further comprising:

a flexible antiscattering blade extending from an inner wall of the cleaning unit, the antiscattering blade abutting the cleaner shaft to prevent scattering of the removed toner into an area of the toner container under the cleaner roller.

9. The cleaner unit according to claim 1, further comprising:

a toner measurement sensor that is configured to generate a signal when the pressure within the storage space meets a predetermined value.

10. The cleaner unit according to claim 1, wherein the toner retaining member is a reed valve.

11. The cleaning unit according to claim 10, wherein the reed valve is an elastic plate.

12. A cleaner unit comprising:

a cleaner roller made of silicone rubber foam;

a cleaner shaft made of metal;

a blade made of polyurethane;

a toner container that includes a storage space configured to store toner and an opening allowing toner to be delivered to the storage space; and a toner squeeze pump that is provided outside the storage space, the toner squeeze pump including an elliptic rotor having a substantially elliptic cross section;

a rotor housing provided to enclose the elliptic rotor; and a toner retaining member in the form of an elastic plate, the toner retaining member configured to prohibit the toner from flowing backward outside of the storage space, wherein the elliptic rotor is configured to rotate around a rotation axis orthogonal to the elliptic cross section of the elliptic rotor, the rotor housing has a first wall and a second wall, the first wall continuing from the opening and the second wall extending orthogonal to the first wall, and the toner retaining member slidably abuts on a peripheral surface of the elliptic rotor from a side of the opening in the storage space toward a rotation center of the elliptic rotor, and wherein the cleaner shaft is configured to rotates in contact with the cleaner roller and collect toner that adheres to a surface of the cleaner roller to be transferred to a surface of the cleaner shaft, the blade is configured to be brought into contact with the cleaner shaft and scrapes off the toner adhered to the surface of the cleaner shaft, the toner squeeze pump is configured to deliver the toner scraped off by the blade toward the opening of the storage space and compresses the toner stored in the storage space, a part of a bottom wall of the toner container which continues from the opening extends in a substantially horizontal direction, when the cleaner unit is attached to an image forming apparatus.

13. The cleaner unit according to claim 12, wherein a part of the rotor housing which has the first wall and the second wall is integrally formed with the toner container.

14. The cleaner unit according to claim 13, wherein a surface of the second wall which faces the elliptic rotor is substantially parallel to a perpendicular direction.

15. The cleaner unit according to claim 12, wherein a taper portion where a width size is tapered toward an apex of the second wall is provided at least on a side of the apex.

16. The cleaner unit according to claim 12, wherein the toner container is designed as a long member extending in a substantially horizontal direction, when the cleaner unit is attached to the image forming apparatus.

17. An electrophotographic image forming apparatus comprising the cleaner unit according to claim 12 which is detachable from the apparatus.

18. The cleaning unit according to claim 12, wherein the toner retaining member is a reed valve.

* * * * *